US008317284B2

(12) United States Patent
Letendre, Jr. et al.

(10) Patent No.: US 8,317,284 B2
(45) Date of Patent: Nov. 27, 2012

(54) METHOD AND APPARATUS TO PROVIDE VARIABLE DROP SIZE EJECTION BY DAMPENING PRESSURE INSIDE A PUMPING CHAMBER

(75) Inventors: William R. Letendre, Jr., Etna, NH (US); Robert Hasenbein, Enfield, NH (US)

(73) Assignee: Fujifilm Dimatix, Inc., Lebanon, NH (US)

( * ) Notice: Subject to any disclaimer, the term of this patent is extended or adjusted under 35 U.S.C. 154(b) by 563 days.

(21) Appl. No.: 12/426,145

(22) Filed: Apr. 17, 2009

(65) Prior Publication Data

US 2009/0289983 A1 Nov. 26, 2009

Related U.S. Application Data

(60) Provisional application No. 61/055,637, filed on May 23, 2008.

(51) Int. Cl.
*B41J 29/38* (2006.01)

(52) U.S. Cl. ..... 347/11; 347/5; 347/9; 347/10

(58) Field of Classification Search ..... 347/5, 9–11
See application file for complete search history.

(56) References Cited

U.S. PATENT DOCUMENTS

| | | | | |
|---|---|---|---|---|
| 5,265,315 | A | 11/1993 | Hoisington et al. | |
| 5,757,392 | A * | 5/1998 | Zhang | 347/14 |
| 6,141,113 | A | 10/2000 | Takahashi | |
| 6,412,923 | B1 | 7/2002 | Takahashi | |
| 6,575,544 | B2 | 6/2003 | Iriguchi | |
| 6,663,208 | B2 | 12/2003 | Suzuki et al. | |
| 6,886,924 | B2 | 5/2005 | Hasenbein et al. | |
| 7,281,778 | B2 * | 10/2007 | Hasenbein et al. | 347/11 |
| 7,303,264 | B2 | 12/2007 | Bibl et al. | |
| 7,520,580 | B2 * | 4/2009 | Iriguchi | 347/11 |
| 2005/0041073 | A1 | 2/2005 | Fontaine et al. | |
| 2005/0212840 | A1 * | 9/2005 | Iriguchi | 347/9 |
| 2006/0012624 | A1 * | 1/2006 | Vanhooydonck | 347/15 |
| 2006/0164450 | A1 | 7/2006 | Hoisington et al. | |
| 2006/0181557 | A1 | 8/2006 | Hoisington et al. | |
| 2008/0074451 | A1 | 3/2008 | Hasenbein et al. | |
| 2008/0170088 | A1 | 7/2008 | Letendre et al. | |

OTHER PUBLICATIONS

International Preliminary Report on Patentability for PCT Patent Application No. PCT/US2009/0436I6, Jan. 22, 2010, 11 pgs.
International Preliminary Report on Patentability for PCT Patent Application No. PCT/US2009/043616, Nov. 23, 2010, 5 pages.
International Search Report and Written Opinion for PCT Patent Application No. PCT/US2009/043616, Jan. 22, 2010, 11 pages.

* cited by examiner

*Primary Examiner* — Jason Uhlenhake
(74) *Attorney, Agent, or Firm* — Blakely, Sokoloff, Taylor & Zafman LLP

(57) ABSTRACT

Described herein is a method and apparatus for driving a droplet ejection device with multi-pulse waveforms. In one embodiment, a method for driving a droplet ejection device having an actuator includes applying a multi-pulse waveform having two or more drive pulses and a cancellation pulse to the actuator. The method further includes generating a pressure response wave in a pumping chamber in response to each pulse. The method further includes causing the droplet ejection device to eject a droplet of a fluid in response to the drive pulses of the multi-pulse waveform. The method further includes canceling the pressure response waves associated with the drive pulses with the pressure response wave associated with the cancellation pulse.

15 Claims, 12 Drawing Sheets

METHOD AND APPARATUS TO PROVIDE VARIABLE DROP SIZE EJECTION BY DAMPENING PRESSURE INSIDE A PUMPING CHAMBER

This application is related to co-pending U.S. Provisional Patent Application No. 61/055,637, which was filed on May 23, 2008; this application claims the benefit of the provisional's filing date under 35 U.S.C. §119(e) and is hereby incorporated herein by reference in its entirety.

TECHNICAL FIELD

Embodiments of the present invention relate to droplet ejection, and more specifically to using a cancellation pulse to dampen pressure inside a pumping chamber for variable drop size ejection.

BACKGROUND

Droplet ejection devices are used for a variety of purposes, most commonly for printing images on various media. They are often referred to as ink jets or ink jet printers. Drop-on-demand droplet ejection devices are used in many applications because of their flexibility and economy. Drop-on-demand devices eject one or more droplets in response to a specific signal, usually an electrical waveform that may include a single pulse or multiple pulses. Different portions of a multi-pulse waveform can be selectively activated to produce the droplets.

Droplet ejection devices typically include a fluid path from a fluid supply to a nozzle path. The nozzle path terminates in a nozzle opening from which drops are ejected. Droplet ejection is controlled by pressurizing fluid in the fluid path with an actuator, which may be, for example, a piezoelectric deflector, a thermal bubble jet generator, or an electrostatically deflected element. The actuator changes geometry or bends in response to an applied voltage. The bending of the piezoelectric layer pressurizes ink in a pumping chamber located along the ink path. Deposition accuracy is influenced by a number of factors, including the volume and velocity uniformity of drops ejected by the nozzles in the head and among multiple heads in a device. The droplet size and droplet velocity uniformity are in turn influenced by factors such as the dimensional uniformity of the ink paths, acoustic interference effects, contamination in the ink flow paths, and the actuation uniformity of the actuators.

Each ink jet has a natural frequency which is related to the inverse of the period of a sound wave propagating through the length of the ejector (or jet). The jet natural frequency can affect many aspects of jet performance. For example, the jet natural frequency typically affects the frequency response of the printhead. Typically, the jet velocity remains near a target velocity for a range of frequencies from substantially less than the natural frequency up to about 25% of the natural frequency of the jet. As the frequency increases beyond this range, the jet velocity begins to vary by increasing amounts. This variation is caused, in part, by residual pressures and flows from the previous drive pulse(s). These pressures and flows interact with the current drive pulse and can cause either constructive or destructive interference, which leads to the droplet firing either faster or slower than it would otherwise fire. Constructive interference increases the effective amplitude of a drive pulse, increasing droplet velocity. Conversely, destructive interference decreases the effective amplitude of a drive pulse, thereby decreasing droplet velocity.

FIG. 1 illustrates a waveform of an ink jet according to a prior approach. The ink jet includes an actuator that is flexed or fired when voltage is applied. This waveform fires a droplet by first creating an initial negative pressure (fill) and then holds the actuator in this position as a pressure wave propagates through a pumping chamber. Upon the reflection of pressure wave at the end of the chamber, the actuator applies a positive pressure (fire) in phase with the pressure wave's reflection. Subsequent drive pulses may constructively or destructively interfere with previous pressure waves leading to variations in droplet velocity.

The volume of a single ink droplet ejected by a jet in response to a multi-pulse waveform increases with each subsequent pulse. The accumulation and ejection of ink from the nozzle in response to a multi-pulse waveform is illustrated in FIG. 2. Prior to an initial pulse, ink within an ink jet terminates at a meniscus which is curved back slightly (due to internal pressure) from an orifice of a nozzle. Following the ejection of a droplet, the ink within an ink jet should again terminate at the meniscus within a nozzle. The waveform in FIG. 1 produces a meniscus bounce as illustrated in FIG. 2 based on a portion of an ink droplet not breaking off and being ejected. Rather, this portion oscillates and stays attached to ink within the nozzle. This can lead to more variation in ejected droplet volume and adversely affect subsequent droplet ejection.

BRIEF DESCRIPTION OF THE DRAWINGS

The present invention is illustrated by way of example, and not by way of limitation, in the figures of the accompanying drawings and in which.

DETAILED DESCRIPTION

Described herein is a method and apparatus for driving a droplet ejection device with multi-pulse waveforms. In one embodiment, a method for driving a droplet ejection device having an actuator includes applying a multi-pulse waveform having two or more drive pulses and a cancellation pulse to the actuator. The method further includes generating a pressure response wave in a pumping chamber in response to each pulse. The method further includes causing the droplet ejection device to eject a droplet of a fluid in response to one or more pressure response waves associated with the drive pulses of the multi-pulse waveform. The method further includes canceling the pressure response waves associated with the drive pulses with the pressure response wave associated with the cancellation pulse.

Figure 3:
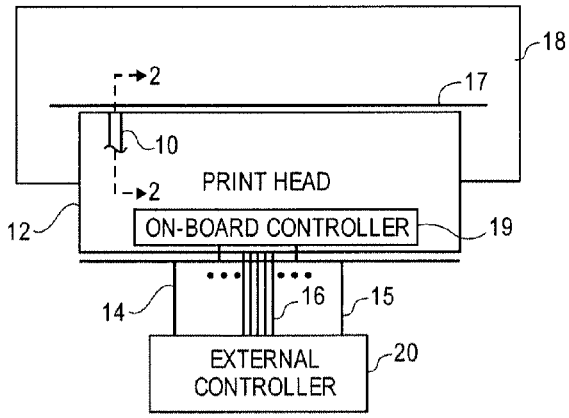
FIG. 3 is a piezoelectric ink jet print head in accordance with one embodiment.

FIG. 3 is a piezoelectric ink jet print head in accordance with one embodiment. As shown in FIG. 3, the 128 individual droplet ejection devices 10 (only one is shown on FIG. 3) of print head 12 are driven by constant voltages provided over supply lines 14 and 15 and distributed by on-board control circuitry 19 to control firing of the individual droplet ejection devices 10. External controller 20 supplies the voltages over lines 14 and 15 and provides control data and logic power and timing over additional lines 16 to on-board control circuitry 19. Ink jetted by the individual ejection devices 10 can be delivered to form print lines 17 on a substrate 18 that moves under print head 12. While the substrate 18 is shown moving past a stationary print head 12 in a single pass mode, alternatively the print head 12 could also move across the substrate 18 in a scanning mode.

Figure 4:
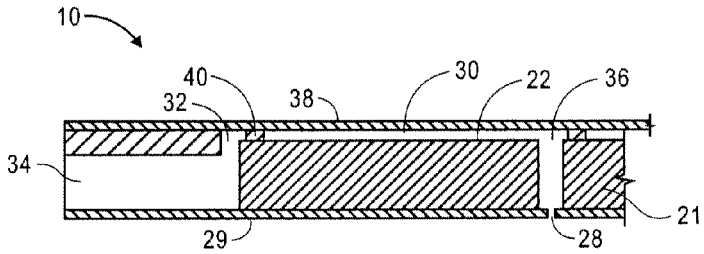
FIG. 4 is a cross-sectional side view through an ink jet module in accordance with one embodiment.

FIG. 4 is a cross-sectional side view through an ink jet module in accordance with one embodiment. Referring to FIG. 4, each droplet ejection device 10 includes an elongated pumping chamber 30 in the upper face of semiconductor block 21 of print head 12. Pumping chamber 30 extends from an inlet 32 (from the source of ink 34 along the side) to a nozzle flow path in descender passage 36 that descends from the upper surface 22 of block 21 to a nozzle opening 28 in lower layer 29. A flat piezoelectric actuator 38 covering each pumping chamber 30 is activated by a voltage provided from line 14 and switched on and off by control signals from on-board circuitry 19 to distort the piezoelectric actuator shape and thus the volume in chamber 30 and discharge a droplet at the desired time in synchronism with the relative movement of the substrate 18 past the print head device 12. A flow restriction 40 is provided at the inlet 32 to each pumping chamber 30.

Figure 5:
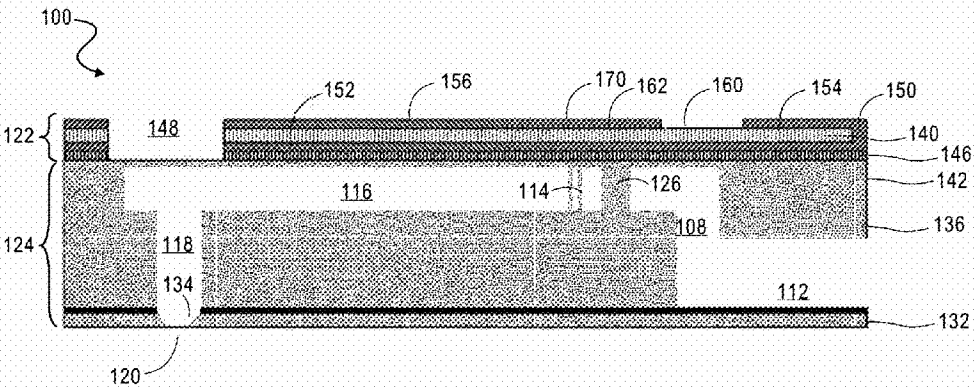
FIG. 5 illustrates a piezoelectric drop on demand printhead module for ejecting drops of ink on a substrate to render an image in accordance with one embodiment.

FIG. 5 illustrates a piezoelectric drop on demand printhead module for ejecting drops of ink on a substrate to render an image in accordance with one embodiment. The module has a series of closely spaced nozzle openings from which ink can be ejected. Each nozzle opening is served by a flow path including a pumping chamber where ink is pressurized by a piezoelectric actuator. Other modules may be used with the techniques described herein.

Referring to FIG. 5, which illustrates a cross-section through a flow path of a single jetting structure in a module 100, ink enters the module 100 through a supply path 112, and is directed by an ascender 108 to an impedance feature 114 and a pumping chamber 116. Ink flows around a support 126 prior to flowing through the impedance feature 114. Ink is pressurized in the pumping chamber by an actuator 122 and directed through a descender 118 to a nozzle opening 120 from which drops are ejected.

The flow path features are defined in a module body 124. The module body 124 includes a base portion, a nozzle portion and a membrane. The base portion includes a base layer of silicon (base silicon layer 136). The base portion defines features of the supply path 112, the ascender 108, the impedance feature 114, the pumping chamber 116 and the descender 118. The nozzle portion is formed of a silicon layer 132. In one embodiment, the nozzle silicon layer 132 is fusion bonded to the silicon layer 136 of the base portion and defines tapered walls 134 that direct ink from the descender 118 to the nozzle opening 120. The membrane includes a membrane silicon layer 142 that is fusion bonded to the base silicon layer 136, opposite to the nozzle silicon layer 132.

In one embodiment, the actuator 122 includes a piezoelectric layer 140 that has a thickness of about 21 microns. The piezoelectric layer 140 can be designed with other thicknesses as well. A metal layer on the piezoelectric layer 140 forms a ground electrode 152. An upper metal layer on the piezoelectric layer 140 forms a drive electrode 156. A wrap-around connection 150 connects the ground electrode 152 to a ground contact 154 on an exposed surface of the piezoelectric layer 140. An electrode break 160 electrically isolates the ground electrode 152 from the drive electrode 156. The metallized piezoelectric layer 140 is bonded to the silicon membrane 142 by an adhesive layer 146. In one embodiment, the adhesive is polymerized benzocyclobutene (BCB) but may be various other types of adhesives as well.

The metallized piezoelectric layer 140 is sectioned to define active piezoelectric regions over the pumping chambers 116. In particular, the metallized piezoelectric layer 140 is sectioned to provide an isolation area 148. In the isolation area 148, piezoelectric material is removed from the region over the descender. This isolation area 148 separates arrays of actuators on either side of a nozzle array.

Figure 6:
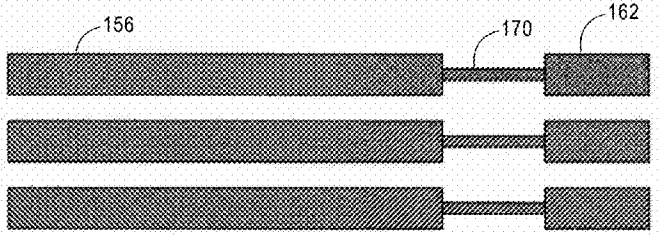
FIG. 6 illustrates a top view of a series of drive electrodes corresponding to adjacent flow paths in accordance with one embodiment.

FIG. 6 illustrates a top view of a series of drive electrodes corresponding to adjacent flow paths in accordance with one embodiment. Each flow path has a drive electrode 156 connected through a narrow electrode portion 170 to a drive electrode contact 162 to which an electrical connection is made for delivering drive pulses. The narrow electrode portion 170 is located over the impedance feature 114 and reduces the current loss across a portion of the actuator 122 that need not be actuated. Multiple jetting structures can be formed in a single printhead die. In one embodiment, during manufacture, multiple dies are formed contemporaneously.

A PZT member or element (e.g., actuator) is configured to vary the pressure of fluid in the pumping chambers in response to the drive pulses applied from the drive electronics. For one embodiment, the actuator ejects droplets of a fluid from the pumping chambers. The drive electronics are coupled to the PZT member. During operation of the printhead module, the actuators eject a droplet of a fluid from a pumping chamber. The drive electronics are coupled to the actuator with the drive electronics driving the actuator with a multi-pulse waveform having two or more drive pulses and a cancellation pulse to cause the actuator to eject the droplet of the fluid in response to generating pressure response waves in the pumping chamber in response to each drive pulse. The pressure response wave associated with the cancellation pulse dampens the pressure response waves associated with the drive pulses to reduce interference with subsequent drive pulses that generate additional pressure response waves. In one embodiment, at least two of the ejected droplets have different droplet sizes with each droplet being ejected at substantially the same effective drop velocity.

In normal operation, the piezoelectric element is actuated first in a manner that increases the volume of the pumping chamber, and then, after a period of time, the piezoelectric element is deactuated so that it returns to its original position. Increasing the volume of the pumping chamber causes a negative pressure wave to be launched. This negative pressure starts in the pumping chamber and travels toward both ends of the pumping chamber towards the orifice and towards the ink fill passage. When the negative wave reaches the end of the pumping chamber and encounters the large area of the ink fill passage, which communicates with an approximated free surface, the negative wave is reflected back into the pumping chamber as a positive wave, traveling towards the orifice. The returning of the piezoelectric element to its original position also creates a positive wave. The timing of the deactuation of the piezoelectric element is such that its positive wave and the reflected positive wave are additive when they reach the orifice.

Figure 7:
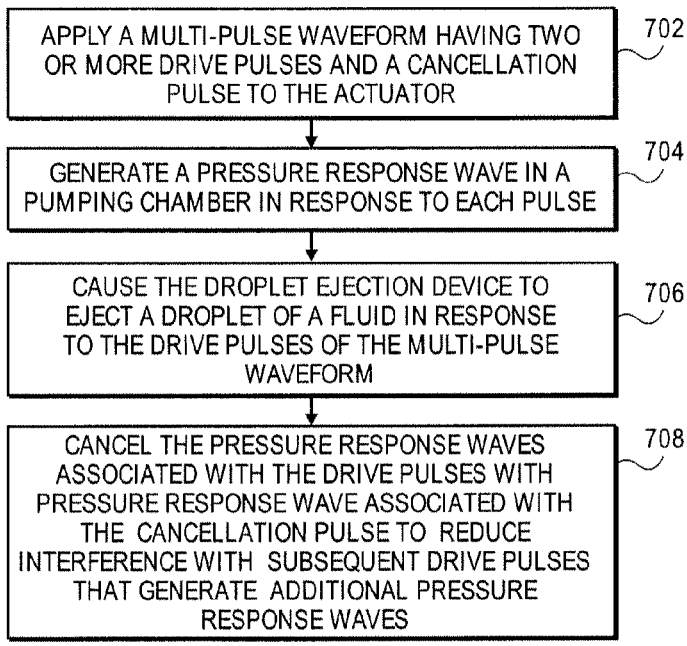
FIG. 7 illustrates a flow diagram of an embodiment for driving a droplet ejection device with multi-pulse waveforms.

The pressure waves generated by drive pulses reflect back and forth in the jet at the natural or resonant frequency of the jet. The pressure waves, normally, travel from their origination point in the pumping chamber, to the ends of the jet, and back under the pumping chamber, at which point they would influence a subsequent drive pulse. However, various parts of the jet can give partial reflections adding to the complexity of the response. FIG. 7 illustrates a flow diagram of a process for driving a droplet ejection device with multi-pulse waveforms in accordance with one embodiment. The process for driving a droplet ejection device having an actuator includes applying a multi-pulse waveform having two or more drive pulses and a cancellation pulse to the actuator at processing block 702. The process further includes generating a pressure response wave in a pumping chamber in response to each pulse at processing block 704. The process further includes causing the droplet ejection device to eject a droplet of a fluid in response to the pressure response waves associated with the drive pulses of the multi-pulse waveform at processing block 406. The process further includes canceling, or substantially reducing, the pressure response waves associated with the drive pulses with the pressure response wave associated with the cancellation pulse at processing block 408. In some embodiments, at least two droplets have different droplet sizes with each droplet being ejected at substantially the same effective drop velocity from a nozzle to a target.

In one embodiment, the two or more of the drive pulses have approximately the same frequency. The pressure response waves associated with the drive pulses are in phase with respect to each other and combine constructively. In this embodiment, the pressure response wave associated with the cancellation pulse is designed out of phase (e.g., 90 degrees) with respect to the pressure response waves associated with the drive pulses in order to combine destructively with the pressure response waves associated with the drive pulses.

In another embodiment, the two or more drive pulses have different frequencies. Additional cancellation pulses may be needed to cancel pressure response waves associated with drive pulses having different frequencies.

In one embodiment, the droplet ejection device ejects additional droplets of the fluid in response to the pulses of the multi-pulse waveform or in response to pulses of additional multi-pulse waveforms. A waveform may include a series of sections that are concatenated together. Each section may include a certain number of samples that include a fixed time period (e.g., 1 to 3 microseconds) and associated amount of data. The time period of a sample is long enough for control logic of the drive electronics to enable or disable each jet nozzle for the next waveform section. In one embodiment, the waveform data is stored in a table as a series of address, voltage, and flag bit samples and can be accessed with software. A waveform provides the data necessary to produce a single sized droplet and various different sized droplets. For example, a waveform can operate at a frequency of 20 kilo-Hertz (kHz) and produce three different sized droplets by selectively activating different pulses of the waveform. These droplets are ejected at the same target velocity.

Figure 8:
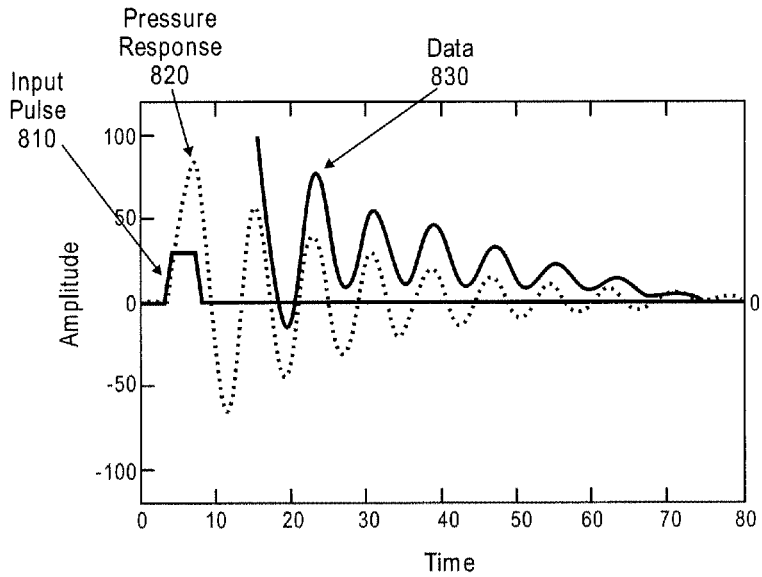
FIG. 8 illustrates a single pulse waveform and associated pressure response wave in accordance with one embodiment.

FIG. 8 illustrates a single pulse waveform and associated pressure response wave in accordance with one embodiment. Referring to FIG. 8, an input pulse 810 applied to an actuator generates a pressure response wave 820 in a pumping chamber that exponentially decays. In one embodiment, the pressure response inside a pumping chamber closely models a second order differential equation ($d^2/dt^2\times(t)+2\zeta\omega_n d/dt\times(t)+\omega_n^2\times(t)-\text{Pulse}(t)=0$), in which the amplitude of the oscillating pressure wave gradually decreases. A data signal 830 corresponds to the pressure response wave 820. The data signal 830 represents the frequency response of a jet array plotted in the time domain. For example, this could represent normalized velocity response decay versus time between fire pulses.

A waveform causes the firing of a droplet by first creating an initial negative pressure (fill), then holding the PZT in this position as the pressure wave propagates through the pumping chamber. When the pressure wave reflects back toward the nozzle, the PZT applies a positive pressure (fire) in phase with the pressure wave's reflection. The waveform produces the native drop size from the jet.

After this drop is fired, the pressure wave reflects away from the nozzle and continues to oscillate in the chamber, which can interfere with the next fire pulse. To dampen the pressure wave, a cancellation pulse applies positive pressure out of phase with the reflected pressure wave. The positive pressure wave interferes with the reflected pressure wave and cancels it out. The pumping chamber is then ready for the next fire pulse.

Figure 9:
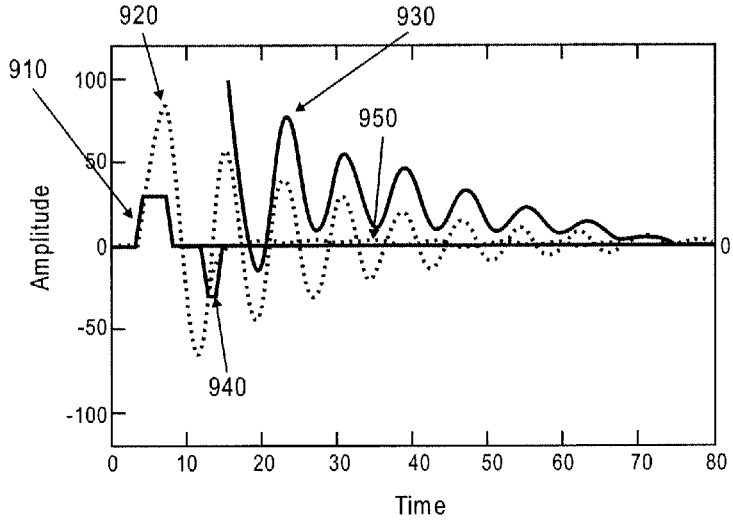
FIG. 9 illustrates a multi-pulse waveform with a drive pulse and a cancellation pulse and associated pressure response waves in a pumping chamber in accordance with one embodiment.

FIG. 9 illustrates a multi-pulse waveform with a drive pulse and a cancellation pulse and associated pressure response waves in a pumping chamber in accordance with one embodiment. Referring to FIG. 9, an input pulse 910 generates a pressure response wave 920 that would normally exponentially decay according to the previously discussed second order differential equation. However, a pressure response wave associated with the cancellation pulse 940 dampens the pressure response wave 920 to create the pressure response wave 950, which has an amplitude of approximately zero and will not interfere with subsequent input pulses. A data signal 930 corresponds to the pressure response wave 920 in a similar manner as the data signal 830 and corresponding pressure response wave 820. Note that the data signal 930 is not affected by the cancellation pulse 940. The data signal 930 represents the frequency response of a jet array plotted in the time domain.

Figure 10:
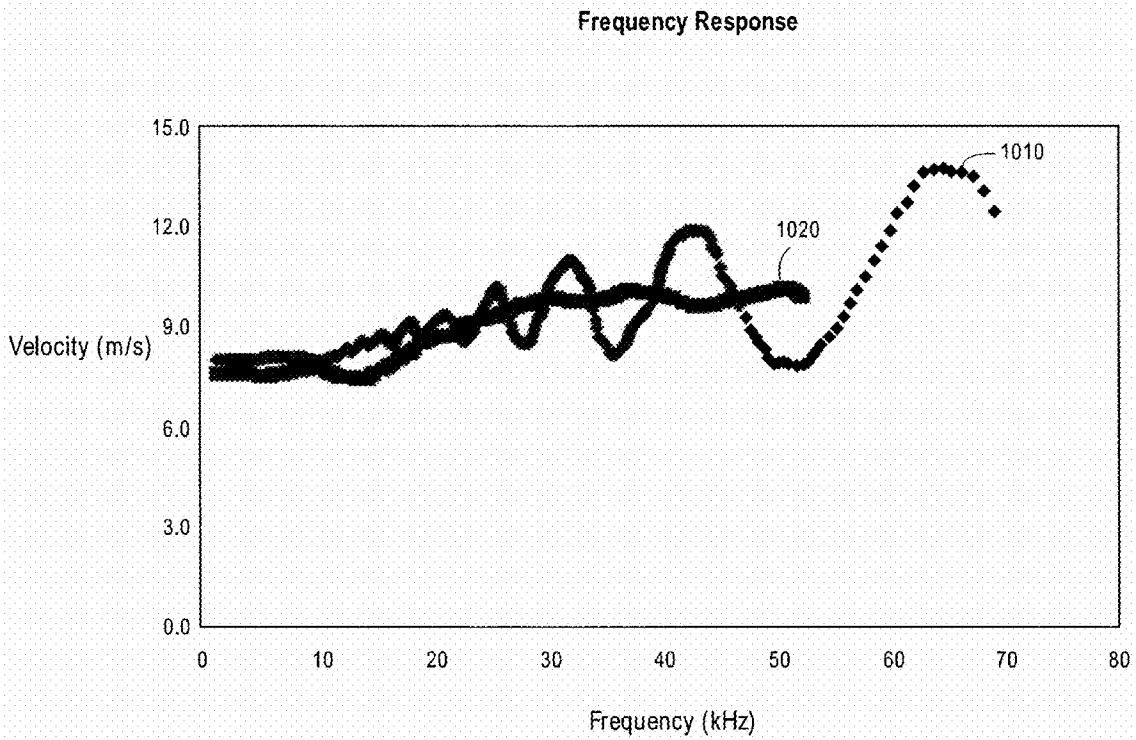
FIG. 10 illustrates a drop velocity versus frequency response graph with and without a cancellation pulse in accordance with one embodiment.

FIG. 10 illustrates a drop velocity versus frequency response graph with and without a cancellation pulse in accordance with one embodiment. Frequency response is measured by firing a waveform at a set voltage through a frequency range and measuring drop velocity from initiation of a firing pulse to a certain distance from the ejection nozzle (e.g., 0.5 millimeter (mm), 1.0 mm) at each frequency. FIG. 10 illustrates how the acoustical energy within a jet propagates and the acoustical energy affects performance, as well as the performance uniformity across a frequency range. Referring to FIG. 10, plot 1010 represents the frequency response for a printhead with no cancellation pulse. In contrast, plot 1020 represents the frequency response for the printhead with a cancellation pulse. The ejection velocity is more uniform with less variation for plot 1020 in comparison to plot 1010. The cancellation pulse dampens residual pressure response waves to improve the ejection velocity across a range of frequencies. Velocity uniformity across a printhead is an important metric for good image quality. In one embodiment, a printhead has a standard deviation of velocity across all jets that is less than ten percent of the average velocity at standard test conditions.

Figure 11A:
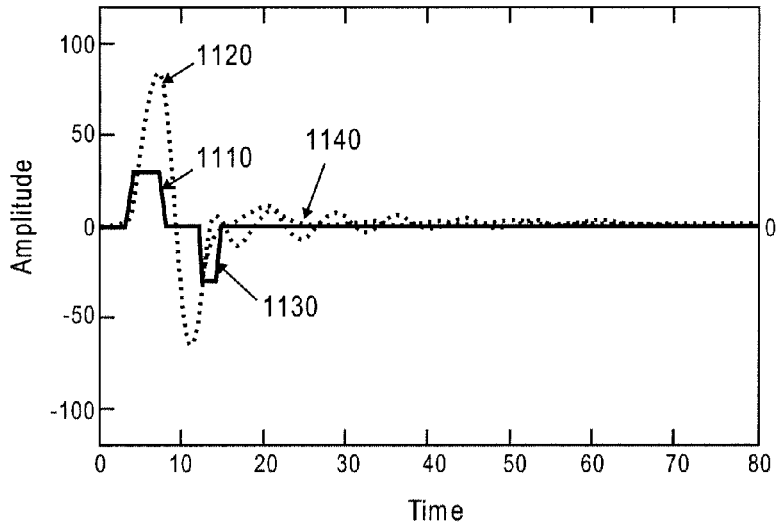
FIGS. 11A and 11B illustrate multi-pulse waveforms having a drive pulse and a cancellation pulse and corresponding pressure response waves in an actuator in accordance with certain embodiments.
Figure 11B:
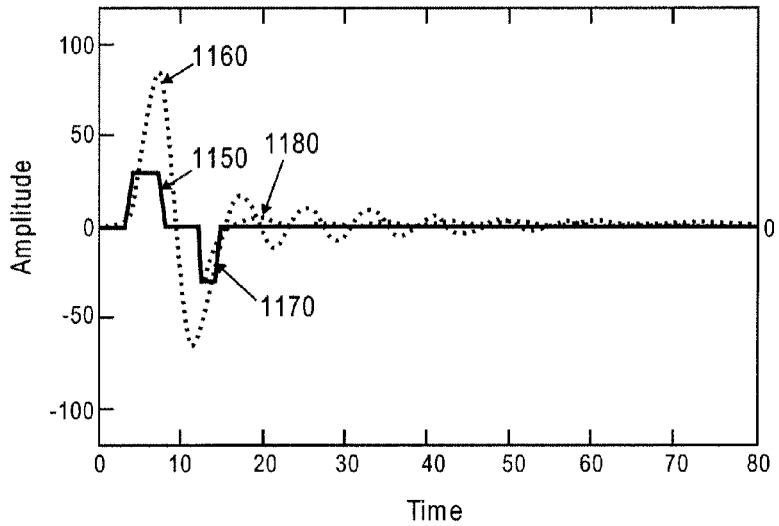

FIGS. 11A and 11B illustrate multi-pulse waveforms each having a drive pulse and a cancellation pulse and corresponding pressure response waves in an actuator in accordance with certain embodiments. In FIG. 11A, an input pulse 1110 generates a pressure response wave 1120 that would normally exponentially decay according to the previously discussed second order differential equation. However, the cancellation pulse 1130 and associated pressure response wave 1140 dampens the pressure response wave 1120, which has an amplitude of approximately zero subsequent to the firing of the cancellation pulse 1130 and will not interfere with subsequent input pulses.

In a similar manner to FIG. 11A, FIG. 11B illustrates an input pulse 1150 that generates a pressure response wave 1160 that would normally exponentially decay. However, a cancellation pulse 1170 and associated pressure response wave 1180 dampens the pressure response wave 1160, which has an amplitude of approximately zero subsequent to the firing of the cancellation pulse 1170 and will not interfere with subsequent input pulses.

Figure 11C:
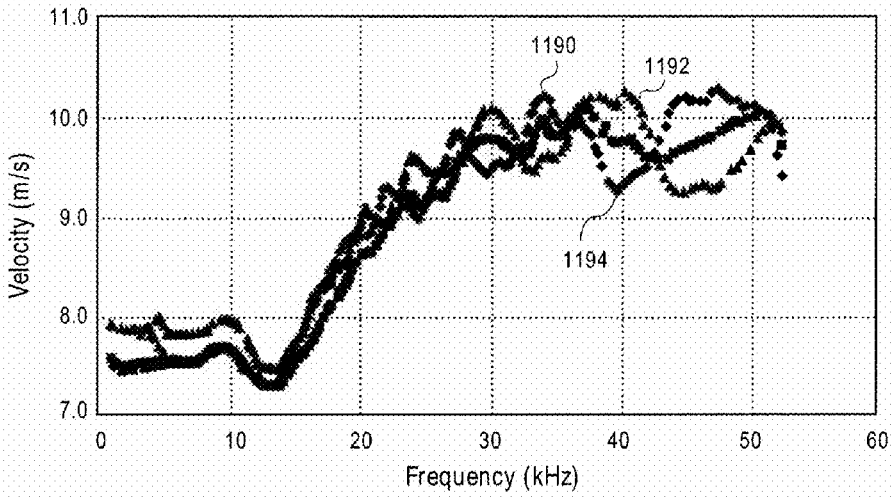
FIG. 11C illustrates a drop velocity versus frequency response graph for the multi-pulse waveforms illustrated in FIGS. 11A and 11B in accordance with one embodiment.

FIG. 11C illustrates a drop velocity versus frequency response graph for the cancellation pulses illustrated in FIGS. 10, 11A, and 11B in accordance with one embodiment. Plot lines 1190, 1192, and 1194 represent the variation in droplet velocity across a range of frequencies for an ink jet with different types of cancellation pulses. Plot line 1190 is the frequency response for the drive and cancellation pulse illustrated in FIG. 11A. Plot line 1192 is the frequency response for the drive and cancellation pulse illustrated in FIG. 11B. Plot line 1194 is the frequency response for the drive and cancellation pulse illustrated in FIG. 9.

The cancellation pulses discussed above dampen residual pressure response waves to improve the ejection velocity across a range of frequencies. Pulse width, pulse amplitude, delay to the cancellation pulse, and sign (positive or negative voltage) can all be varied in the cancellation pulse to affect the frequency response.

Figure 12:
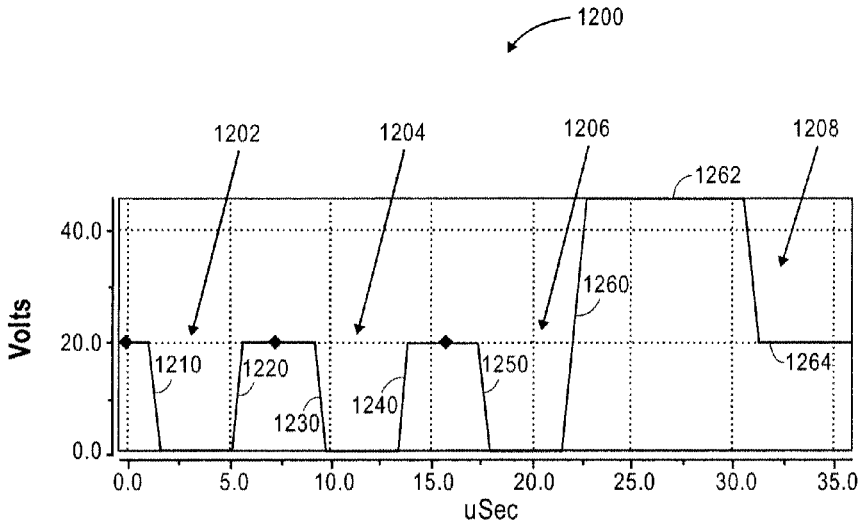
FIG. 12 illustrates an inverted trapezoid multi-pulse waveform having three drive pulses and a cancellation pulse in accordance with one embodiment.

FIG. 12 illustrates an inverted trapezoid multi-pulse waveform having three drive pulses and a cancellation pulse in accordance with another embodiment. The waveform includes drive pulses 1202, 1204, 1206, and cancellation pulse 1208. The waveform 1200 causes an actuator to fire during time periods of applied voltage and fill during time periods with voltage being released. The filling occurs during segments 1210, 1230, and 1250. The firing occurs during segments 1220, 1240, and 1260. The delay between filling and firing is the pulse width. In one embodiment, the pulse width is the delay between a beginning of a pulse change to a beginning of a next pulse change.

In another embodiment, segment 1210 creates an initial negative pressure (fill) and then the actuator is held in this position as a pressure wave propagates through a pumping chamber. Upon the reflection of the pressure wave at the end of the chamber, the actuator applies segment 1220, a positive pressure (fire), to generate another pressure wave in phase with the reflected pressure wave such that the pressure waves combine constructively. In a similar manner, segments 1230 and 1250 generate negative pressure waves that reflect at the end of the chamber. Segments 1240 and 1260 generate positive pressure waves in phase with the reflected pressure waves. Drive pulses 1202, 1204, and 1206 produce the native drop size of the ink jet. In one embodiment, the diamond shapes define endpoints of sections, which can be associated with the drive pulses.

The segment 1260 generates a pressure wave that is reflected at the end of the chamber and continues to oscillate in the chamber, which can interfere with next fire pulse. To dampen the pressure wave and other residual pressure waves, the cancellation pulse 1208 applies positive pressure out of phase with the reflected pressure wave(s). The positive pressure wave interferes destructively with the reflected pressure wave(s) and cancels it out.

A delay segment 1262 separates the fire segment 1260 and the cancellation pulse 1208. The delay segment is 3 to 8 microseconds for one embodiment. The cancellation pulse 1208 may remain at a constant voltage (e.g., 20 volts) for 15 to 25 microseconds prior to additional drive pulses being applied to the actuator to eject another droplet. In one embodiment, the waveform 1200 requires a 35 microsecond time period for three drive pulses and one cancellation pulse in order to produce a droplet and reduce interference between pressure waves. Thus, the waveform 1200 can be used for high frequency applications (e.g., up to 28 kHz) to advantageously provide damping to reduce reflected waves and reduce formation of residual pressure waves and provide more uniform droplet volume and velocity over a wide range of operating frequencies.

Figure 1:
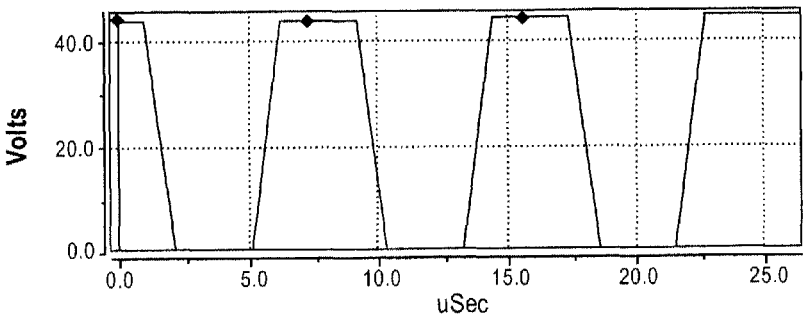
FIG. 1 (PRIOR ART)
FIG. 1 illustrates a waveform of an ink jet according to a prior approach.
Figure 2:
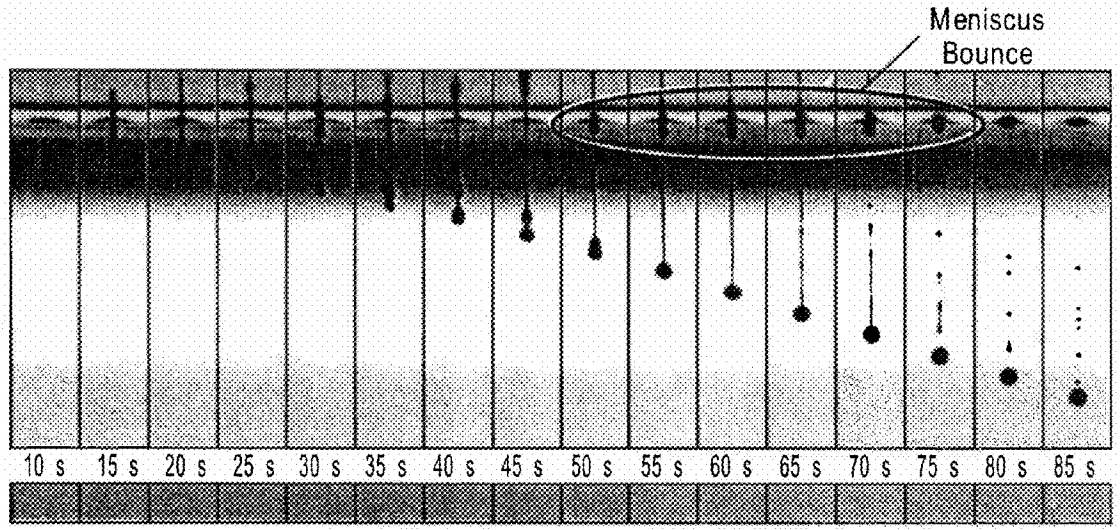
FIG. 2 (PRIOR ART)
FIG. 2 illustrates the accumulation and ejection of ink from a nozzle in response to a multi-pulse waveform according to a prior approach.
Figure 13:
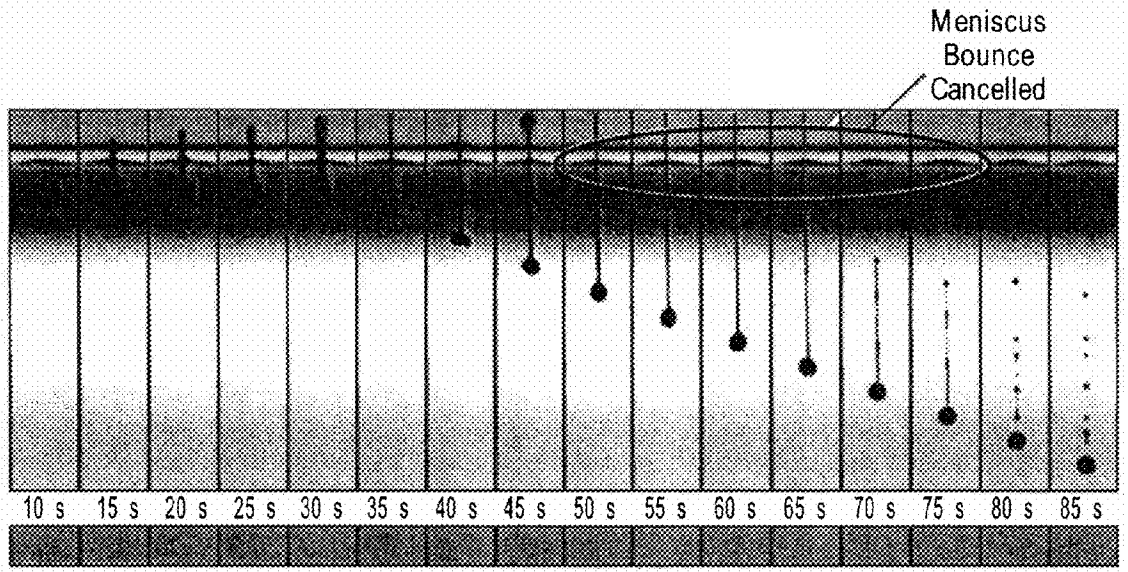
FIG. 13 illustrates drop formation of a waveform in accordance with one embodiment.

FIG. 13 illustrates drop formation of the waveform 1200 in accordance with one embodiment. The waveform 1200 uses three drive pulses to produce three droplets that merge after exiting the nozzle and do not separate into individual droplets prior to forming a single ejected droplet. Each time slice (e.g., 10 microseconds, 15 microseconds) illustrated in FIG. 13 is an image taken at the time shown relative to the initiation of the waveform 1200. An additional advantage of the waveform 1200 is the cancellation of the meniscus bounce previously discussed and illustrated in the 50 to 75 microsecond time slices of FIG. 2. The meniscus bounce may oscillate at a frequency of 7 to 8 kHz and impact the frequency response of the printhead. In contrast to FIG. 2, FIG. 13 does not have a portion of the ink droplet remaining attached to the ink in the nozzle and oscillating back and forth. The ejected droplet cleanly breaks off and the ink meniscus retreats within the nozzle. The cancellation pulse cancels the pressure waves associated with the drive pulses to cancel a meniscus bounce associated with the ejected droplet.

Figure 14:
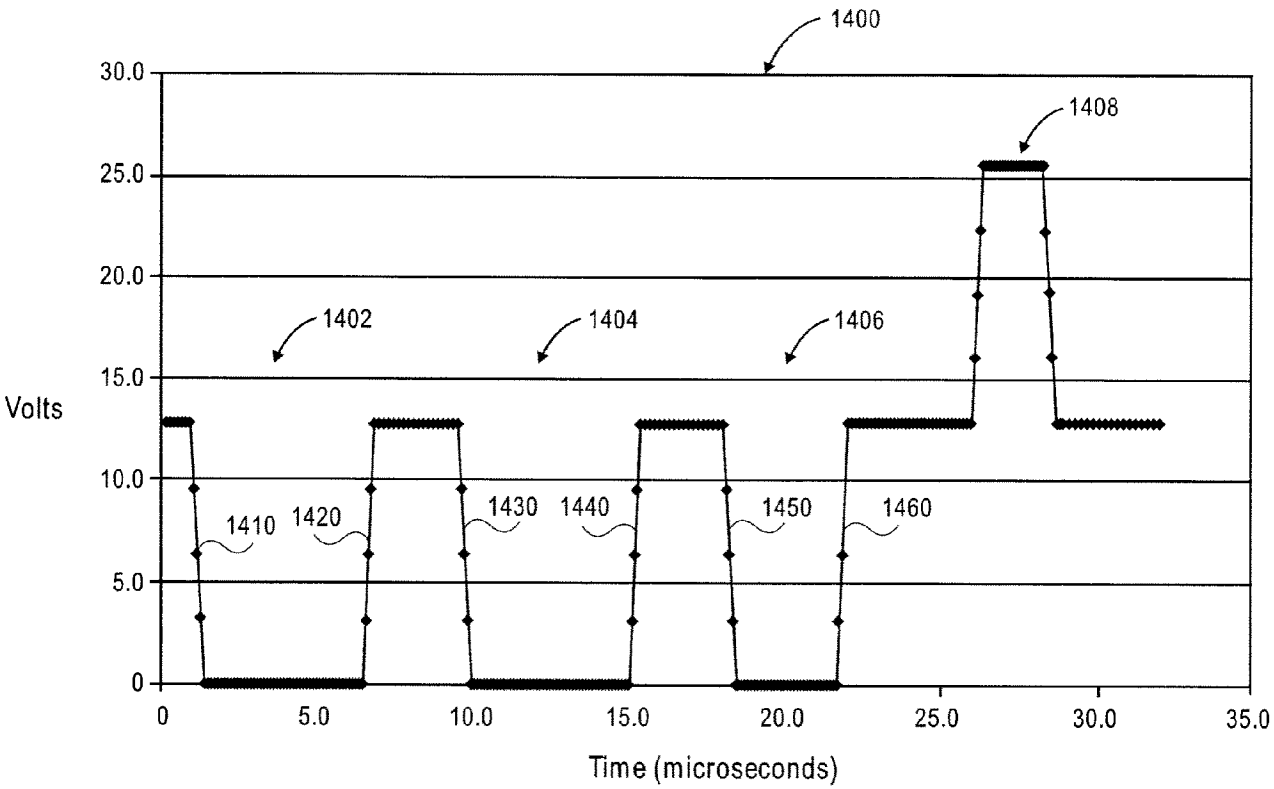
FIG. 14 illustrates an inverted trapezoid multi-pulse waveform having three drive pulses and a cancellation pulse in accordance with another embodiment.

FIG. 14 illustrates an inverted trapezoid multi-pulse waveform having three drive pulses and a cancellation pulse in accordance with another embodiment. The waveform includes drive pulses 1402, 1404, 1406, and cancellation pulse 1408. Waveform 1400 causes an actuator to fire during time periods of applied voltage and fill during time periods with voltage being released. The filling occurs during segments 1410, 1430, and 1450. The firing occurs during segments 1420, 1440, and 1460.

In one embodiment, segment 1410 creates an initial negative pressure (fill) and then the actuator is held in this position as a pressure wave propagates through a pumping chamber. Upon the reflection of the pressure wave at the end of the chamber, the actuator applies segment 1220, a positive pressure (fire), to generate another pressure wave in phase with the reflected pressure wave such that the pressure waves combine constructively. In a similar manner, segments 1430 and 1450 generate negative pressure waves that reflect at the end of the chamber. Segments 1440 and 1460 generate positive pressure waves in phases with the reflected pressure waves. The drive pulses 1402, 1404, and 1406 produce the native drop size of the ink jet.

The segment 1460 generates a pressure wave that is reflected at the end of the chamber and continues to oscillate in the chamber, which can interfere with next fire pulse. To dampen the pressure wave and other residual pressure waves, the cancellation pulse 1408 applies positive pressure out of phase with the reflected pressure wave. The positive pressure wave interferes destructively with the reflected pressure wave and cancels it out.

The waveform 1400 can be used for various high frequency applications (e.g., up to 33 kHz) to advantageously provide damping to reduce reflected waves and reduce formation of residual pressure waves and provide more uniform droplet volume and velocity over a wide range of operating frequencies.

The control and design of various parameters (e.g., amplitude, phase) of one or more cancellation pulses in a waveform reduces the interference of residual pressure waves with pressure waves generated by subsequent pulses. This permits improved drop formation for each drop size, enables improved control over the drop velocities, reduces and/or eliminates a meniscus bounce, and enables ink jet operation over a wide range of frequencies.

It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A method for driving a droplet ejection device having an actuator, comprising:

applying a multi-pulse waveform having two or more drive pulses and a single cancellation pulse to the actuator;

causing the droplet ejection device to eject a droplet of a fluid in response to pressure response waves associated with the two or more drive pulses of the multi-pulse waveform; and canceling the pressure response waves associated with the two or more drive pulses with the pressure response wave associated with the single cancellation pulse, wherein the single cancellation pulse is inverted with respect to the two or more drive pulses and the single cancellation pulse has a pulse width less than a pulse width of each of the two or more drive pulses.

2. The method of claim 1, wherein canceling the pressure response waves associated with the two or more drive pulses with the pressure response wave associated with the single cancellation pulse reduces interference with subsequent drive pulses that generate additional pressure response waves.

3. The method of claim 1, wherein the two or more drive pulses have substantially the same frequency.

4. The method of claim 3, wherein the single cancellation pulse is fired subsequent to the two or more drive pulses.

5. The method of claim 2, wherein the pressure response waves associated with the two or more drive pulses are in phase with respect to each other and combine constructively.

6. The method of claim 5, wherein the pressure response wave associated with the single cancellation pulse is out of phase with respect to the pressure response waves associated with the two or more drive pulses in order to combine destructively to generate a pressure response wave having an amplitude of approximately zero, wherein the two or more drive pulses each include a fill segment, which causes an initial negative pressure response wave, followed by a fire segment, which causes a positive pressure response wave, while the inverted single cancellation pulse includes a segment that causes a positive pressure response wave.

7. The method of claim 1, wherein the multi-pulse waveform comprises three drive pulses and the single cancellation pulse.

8. The method of claim 1, wherein the multi-pulse waveform comprises two drive pulses and the single cancellation pulse.

9. The method of claim 1, wherein the single cancellation pulse cancels the pressure waves associated with the two or more drive pulses to prevent a meniscus bounce associated with the ejected droplet.

10. The method of claim 1, wherein the actuator is operable to vary the pressure of the fluid in the pumping chamber in response to the drive pulses.

11. An apparatus, comprising:

an actuator to eject a droplet of a fluid from a pumping chamber; and drive electronics coupled to the actuator, wherein during operation the drive electronics drive the actuator with a multi-pulse waveform having two or more drive pulses and a single cancellation pulse to cause the actuator to eject the droplet of the fluid in response to pressure response waves in the actuator generated in response to each drive pulse, wherein the single cancellation pulse dampens the pressure response waves associated with the two or more drive pulses to reduce interference with subsequent drive pulses that generate additional pressure response waves, wherein the single cancellation pulse is inverted with respect to the two or more drive pulses and the single cancellation pulse has a pulse width less than a pulse width of each of the two or more drive pulses.

12. The apparatus of claim 11, wherein the droplet ejection device to eject at least three droplets having different droplet sizes with each droplet being ejected at substantially the same effective drop velocity.

13. The apparatus of claim 11, wherein the multi-pulse waveform has three drive pulses and the single cancellation pulse fired during a time period to cause the actuator to eject the droplet of the fluid in response to the drive pulses.

14. The apparatus of claim 13, wherein the time period during which the three drive pulses and single cancellation pulse fire is less than sixty microseconds in duration.

15. The apparatus of claim 11, wherein the two or more drive pulses have substantially the same frequency.

* * * * *